US005752708A

United States Patent [19]

Svensson

[11] Patent Number: 5,752,708

[45] Date of Patent: May 19, 1998

[54] IN-LINE SKATE FRAME

[75] Inventor: John E. Svensson, Vashon, Wash.

[73] Assignee: K-2 Corporation, Vashon, Wash.

[21] Appl. No.: 597,440

[22] Filed: Feb. 2, 1996

[51] Int. Cl.[6] ..... A63C 17/06

[52] U.S. Cl. ..... 280/11.22

[58] Field of Search ..... 280/841, 842, 280/7.13, 11.12, 11.18, 11.19, 11.22, 11.23, 11.25, 11.26, 11.27; 264/162, 177.1, 177.16

[56] References Cited

U.S. PATENT DOCUMENTS

| | | | |
|---|---|---|---|
| D. 347,672 | 6/1994 | Arney et al. . | |
| 2,197,519 | 4/1940 | Demerse | 280/11.23 |
| 3,901,520 | 8/1975 | McMahan | 280/11.23 |
| 5,092,614 | 3/1992 | Malewicz . | |
| 5,340,132 | 8/1994 | Malewicz . | |
| 5,380,020 | 1/1995 | Arney et al. . | |
| 5,385,356 | 1/1995 | Conte | 280/11.27 |
| 5,388,846 | 2/1995 | Gierveld . | |
| 5,513,861 | 5/1996 | Monroy et al. | 280/11.22 |
| 5,549,310 | 8/1996 | Meibock et al. | 280/11.27 |
| 5,630,624 | 5/1997 | Goodman | 280/11.22 |

FOREIGN PATENT DOCUMENTS

| | | |
|---|---|---|
| 2446210 | 4/1975 | Germany . |
| WO 95/03862 | 2/1995 | WIPO . |

*Primary Examiner*—Peter C. English
*Assistant Examiner*—Frank Vanaman
*Attorney, Agent, or Firm*—Christensen O'Connor Johnson & Kindness PLLC

[57] ABSTRACT

A frame for securing in-line skate wheels to a skate boot includes mounting platforms, right and left walls, and cross braces between the walls. The mounting platforms are adapted for securing a skate boot to the frame. The right and left walls extend downwardly from the mounting platform and include lower regions having apertures for securing the wheels thereto. The apertures of the walls are substantially aligned. The cross braces extend diagonally down from either the mounting platform or the walls to the lower portions of the walls. The cross braces extend substantially along the plane substantially parallel to the longitudinal axis of the frame. A method of constructing an in-line skate frame is also provided.

22 Claims, 4 Drawing Sheets

IN-LINE SKATE FRAME

FIELD OF THE INVENTION

The present invention relates to frames for securing in-line skate wheels to a skate boot and, more particularly, to an extruded aluminum in-line skate frame with braces.

BACKGROUND OF THE INVENTION

In-line roller skates include multiple wheels all rotating in a common plane such that a single row of wheels is created beneath each foot of the skater. The construction provides a skater with much of the same feel experienced on an ice skate, while the in-line roller skate may be used on a much wider variety of terrain.

Typical in-line skates include four or five wheels of the same size having parallel axes of rotation within the same horizontal plane, perpendicular to the longitudinal axis of a frame. All of the wheels are carried and rotatably supported within the lower frame. The frame is attached to the base of a shoe or boot. The frame configuration determines the number, size, and location of the in-line wheels used with the skate.

Frames usually vary depending on the intended end use of the skate. Long frames are constructed for speed skating to accommodate five large-diameter wheels. Hockey frames are typically shorter and hold three or, more likely, four wheels. The wheels are fatter and shorter in diameter.

The high speeds of speed skates result from significant lateral thrusting of the skater's legs to the sides. Thus, the long frames and large wheels of a speed skate help the skater attain and maintain high speeds on roads or courses without substantial turns. While the skater angles the frame to transmit the forces efficiently through the walls to the skate boot base, the wheel is on its side. Therefore, lateral forces on the wheel and on the frame necessarily occur. If the frame flexes, forward thrust energy is lost. A light, laterally stiff frame is efficient. Most speed skating frames are constructed of aluminum. They include boot mounting platforms and walls. Some frames include horizontal braces between the walls. Such a brace forms a rectangular section in combination with the frame walls, which may help stiffen the frame if thick enough. However, such a configuration is not completely efficient at resisting lateral loads.

The hockey skate wheel and frame dimensions help the skate to maneuver quickly. A hockey player cuts, stops, turns, and reverses direction frequently and at some speed. The frames are usually made of aluminum with heel and forward platforms and downwardly extending walls. Some frames include horizontal braces between the walls. However, the resulting rectangular support structures may not efficiently counter the extreme lateral loads that often occur during hockey play. The cross sectional shape may change from rectangular to slightly trapezoidal without thick, heavy supports.

The frames of the present invention are more efficient and effective in countering lateral loads and side impacts. Instead of creating rectangular cross-sectional shapes, strong triangles are created with cross bracing. As discussed below, the cross bracing preferably extends diagonally between the walls within planes parallel to the longitudinal axis of the frame. These planes are most efficient in countering the loads encountered during skating, especially hockey and speed skating. Thus, less energy is lost and the skates are more responsive.

SUMMARY OF THE INVENTION

The present invention is directed toward a frame for securing in-line skate wheels to a skate boot. The frame includes at least one mounting platform, a right wall, a left wall, and a first cross brace. The mounting platform is adapted for securing the skate boot thereto. The right wall extends downwardly from the mounting platform and includes a lower region having apertures for securing the wheels thereto. The left wall extends downwardly from the mounting platform and also includes a lower region having apertures for securing the wheels thereto. The apertures of the walls are substantially aligned for placement of axles therebetween. The first cross brace extends diagonally down from one of the right wall and the left wall to the other of the right wall and the left wall. The first cross brace has an upwardly facing surface, a downwardly facing surface, a forward edge, and a rearward edge. The brace also has a lower end attached to one of the walls and an upper end attached to the other of the walls.

In one preferred embodiment of the invention, the first cross brace extends along a plane parallel to the longitudinal axis of the frame. The cross section of the first cross brace combined with the cross section of one of the right and left walls and the cross section of the platform, forms a triangular shape. The first cross brace is attached to one of the walls between two of the apertures. Thus, the lower end of the first cross brace is attached to the lower region of one of the walls. In this manner, the first cross brace is positioned between two wheels, when the wheels are secured to the frame.

Another aspect of the preferred embodiment of the invention includes a second cross brace extending along a plane parallel to the longitudinal axis of the frame, transverse to the first cross brace. The second cross brace extends from an upper portion of one of the walls to a lower portion of the opposite wall. A horizontal brace is also provided extending between the right wall and the left wall. This horizontal brace is generally parallel to the platform. The walls are, preferably, substantially parallel to each other.

In an alternate preferred embodiment of the invention, a frame for securing in-line skate wheels to a skate boot is provided. The frame includes at least one mounting platform, a right wall, a left wall, and a first cross brace. The mounting platform is adapted for securing the skate boot thereto. The right wall and left wall extend downwardly from the mounting platform. Both walls include lower regions having apertures for securing the wheels thereto. The apertures of the walls are substantially aligned. In this embodiment, the first cross brace extends diagonally down from the mounting platform to one of the right wall and the left wall. The first cross brace has an upwardly facing surface, a downwardly facing surface, a forward edge, and a rearward edge. A lower end of the cross brace is attached to one of the walls and an upper end is attached to the mounting platform.

Another aspect of the invention also includes a method of making a skate frame for an in-line skate from a material. The method includes forcing the material through an orifice in a die and machining wheel wells within the material. The die has a cross-sectional orifice shape to form two walls, a first platform, a second platform and a diagonal cross brace in the material. The first platform extends between the two walls. The second platform extends between the two walls and below the first platform. The diagonal cross brace extends from a lower portion of one of the walls to one of the platform and the other of the walls. The wheel wells are machined within the cross brace.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
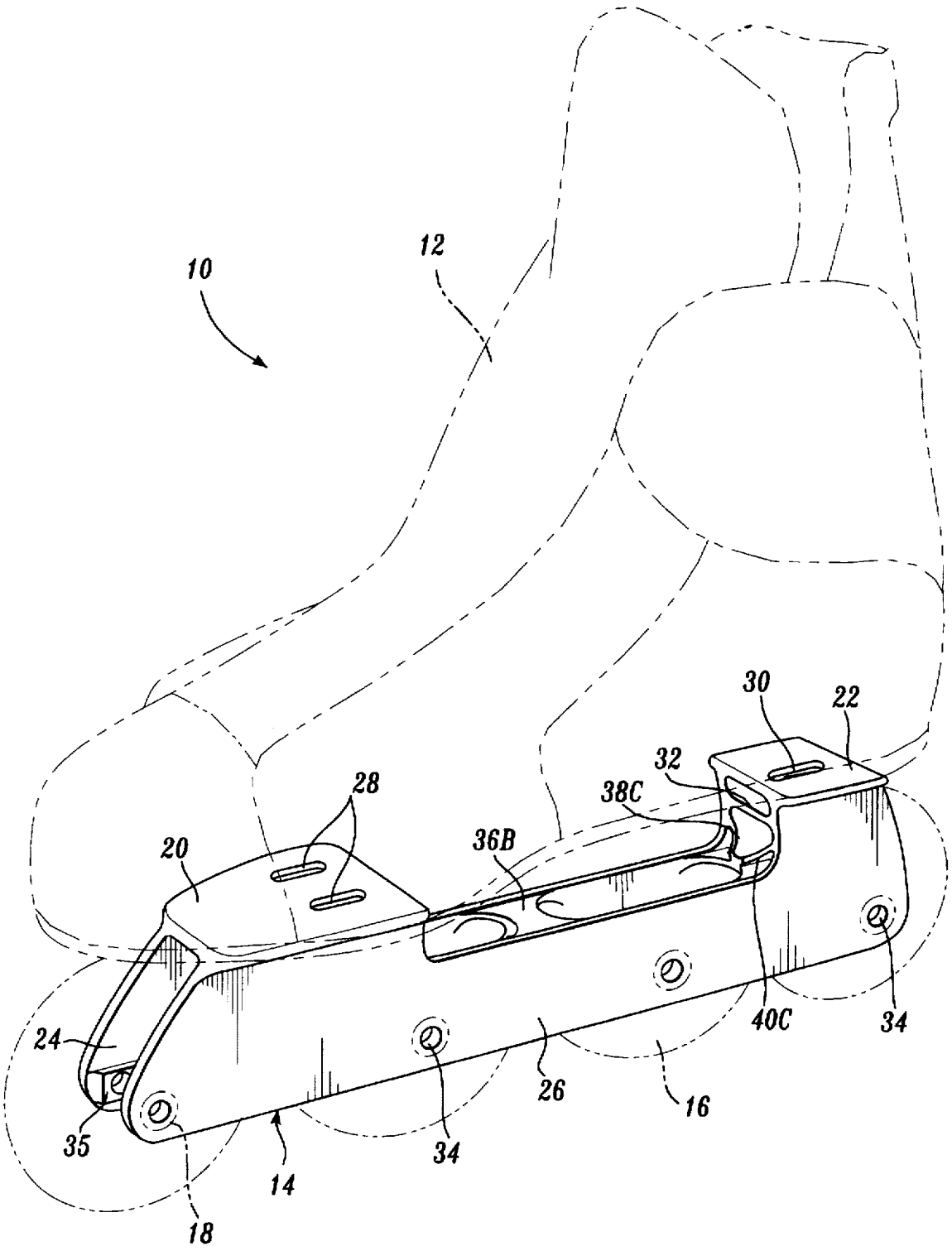
FIG. 1 is a perspective view of a skate frame according to the present invention with a skate and wheels shown in phantom.
Figure 2:
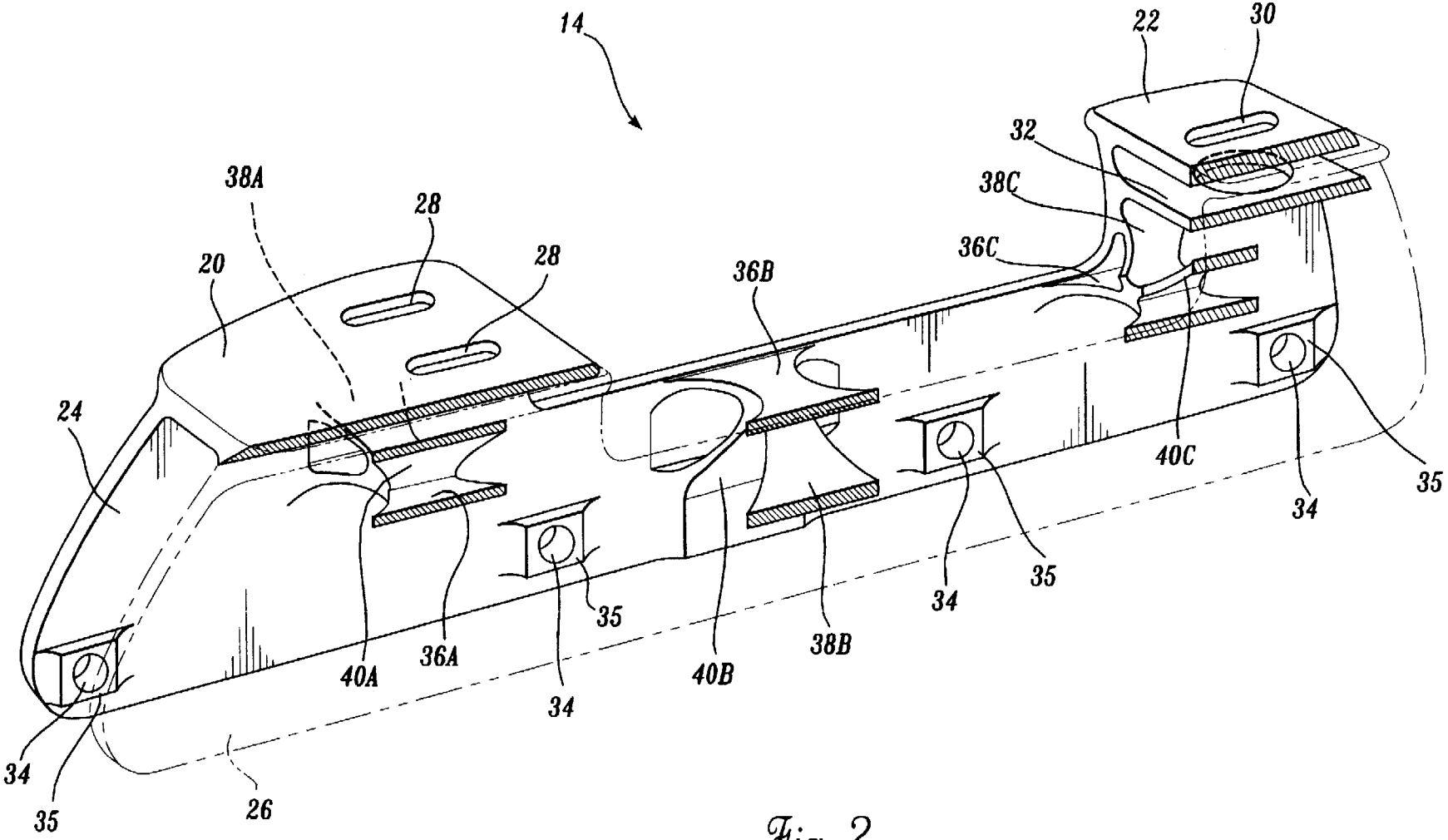
FIG. 2 is a perspective view of a skate frame having one of the walls of the frame cut away to view the cross braces.

Referring first to FIGS. 1 and 2, the first preferred embodiment of the frame of the present invention will be described. A skate 10 is provided that includes a boot 12, a frame 14, and wheels 16. Boot 12 is connected beneath the heel and forward portion of the sole, in the area adjacent the ball of the foot, to the top of frame 14. Boot 12 may be any type of skate boot or shoe such as for hockey, speed, or stunt skating. The sole of boot 12 may alternatively be integrally formed with frame 14. Wheels 16 are rotatably connected to frame 14 with axles 18. Wheels 16 are aligned in a row with parallel axles, one behind another.

Frame 14 is preferably constructed of extruded aluminum, as discussed below with regard to FIGS. 3 and 4. Frame 14, after being machined, includes a forward mounting platform 20, a heel mounting platform 22, a right wall 24, and a left wall 26. Forward mounting platform 20 is positioned at the top, forward end of frame 14 and includes a flat surface, onto which the forward end of the sole of boot 12 may be positioned and secured. Forward mounting apertures 28 extended through within forward mounting platform 20 for this purpose. Forward mounting apertures 28 are preferably elongated slots into which a fastener may be secured. The slots are oriented longitudinally such that boot 12 may be adjusted forwardly or rearwardly, as desired or to accommodate various sizes of boot 12. In the preferred embodiment of the invention, forward mounting platform 20, because it is extruded from the same piece of aluminum as entire frame 14, is substantially horizontal and falls within a plane parallel to the longitudinal axis of frame 14. Forward mounting platform 20 also includes flanges projecting outwardly from the tops of walls 24 and 26 for increased stability and secure mounting to the sole or base of boot 12. The lateral side of the flange of forward mounting platform 20 outwardly extends further than the medial side.

Heel mounting platform 22 is positioned on top of right and left walls 24 and 26 at the rearward end of frame 14. Heel mounting platform 22 is also integrally formed with walls 24 and 26 and forward mounting platform 20. Heel mounting platform 22 is positioned slightly higher than forward mounting platform 20 to secure the heel of boot 12 slightly above the forward portion of the base of boot 12. Heel mounting platform 22 also includes small flanges extending outwardly on the medial and lateral sides of walls 24 and 26. Heel mounting platform 22 includes a heel mounting aperture 30 in the center thereof, for securing the heel boot 12 thereto. Heel mounting aperture 30 is an elongate slot through which a fastener may be secured to the heel of boot 12. As with apertures 28, the elongate slot allows for adjustability of boot 12 relative to frame 14 or for the accommodation of various boot base sizes.

The portion of the aluminum extrusion that creates forward mounting platform 20 also creates horizontal upper brace 32 directly below heel mounting platform 22. These two elements are separated when frame 14 is machined. Horizontal upper brace 32 extends between walls 24 and 26 at the same level as forward mounting platform 20. The portions of walls 24 and 26 between heel mounting platform 22 and forward mounting platform 20 include recesses such that platforms 20 and 22 are projected upwardly by those remaining portions of walls 24 and 26 located directly beneath platforms 20 and 22. The upper edges of walls 24 and 26 between platforms 20 and 22 are parallel to the bottom edges of walls 24 and 26.

Axle apertures 34 are provided in equally spaced relationship along a lower portion or region of walls 24 and 26 to secure wheels 16 on axles 18. The insides of walls 24 and 26, adjacent axle apertures 34, project inwardly to provide integrally formed spacers 35. Frame spacers 35 space the outer races of the bearings of wheels 16 from walls 24 and 26 so the outer races can rotate freely even with high lateral loads on wheels 16.

Due to the lateral loads that may be encountered while skating, especially with hockey skating, frame 14 is provided with several braces between walls 24 and 26. FIG. 2 illustrates several preferred locations for these braces. To understand more completely the make-up and construction of the braces discussed below, reference should also be had to FIGS. 3 and 4. FIG. 4 illustrates an extrusion of aluminum that is used to create the frame illustrated in FIGS. 1 and 2. FIG. 3 is an end view of the extrusion illustrated in FIG. 4. The aluminum is extruded and then machined to create the recesses, wheel wells, apertures, and other features that result in the final frame illustrated in FIGS. 1 and 2. In the preferred embodiment of the invention, a four-wheeled skate is provided. Therefore, this results in three sets of cross braces, one set between each couple of wheels. Hence, common numbers with differing letters (a, b, and c) will be used to designate common cross members created during the extrusion. Note that other fabrication methods, such as pultrusion, could also be used. In FIGS. 3 and 4, the numbers without letters are used since the wheel wells have not been cut between the three final sets of cross braces.

First, a horizontal midbrace is provided that extends between the midportions of walls 24 and 26. After machining wheel wells, horizontal midbrace 36 results in a forward portion **36*a*, a middle portion 36*b*, and a rearward portion 36*c*. The forward and rearward sides of horizontal midbraces 36 are concave for close fitting with wheels 16 and to provide additional strength in their connections with walls 24 and 26. Horizontal midbrace 36 provides impact resistance to frame 14 and maintains the spacing between walls 24 and 26 while skating. The shape created by horizontal midbrace 36 combined with forward mounting platform 20, upper horizontal brace 32 and heel mounting platform 22 is rectangular. Consequently, this brace is not as efficient in countering extreme lateral loads and moments created by wheels 16** when a skater is cornering or stopping, or even thrusting the skate out to the side.

First cross brace 38 and second cross brace 40 are more efficient to counter the forces created during skating. First cross brace 38 extends from an upper portion of right wall 24 to a lower portion of left wall 26 diagonally downward. First cross brace 38 lies within a plane substantially parallel to the longitudinal axis of frame 14. Similar to horizontal midbrace 36, first cross brace 38 includes a forward portion 38*a*, a middle portion 38*b*, and a rearward portion 38*c*. These various portions are created after machining the wheel wells as well as the wall recesses of frame 14, as described above. In the embodiment illustrated in FIG. 2, the lower portions of forward and rearward portions 38*a* and 38*c*, have also been removed. This leaves only upper sections 38*a* extending from right wall 24 down to their intersection with horizontal midbrace forward portion 36*a* and rearward portion 36*c*. However, in alternate preferred embodiments, first cross brace forward and rearward portions 38*a* and 38*c* extend downwardly to an attachment with left wall 26. Alternatively, since frame 14 is integrally formed, a cross brace is effectively created by forward portion 38*a* of first cross brace 38 and the left side portion of horizontal midbrace forward portion 36*a*. In this manner, the walls are effectively interconnected with cross bracing and also with cross bracing provided by second cross brace 40.

Second cross brace 40 also includes forward, middle, and rearward portions 40*a*–40*c*. These portions are mirror images of first cross brace portions 38*a*–38*c*, extending from left wall 26. In this manner, substantial strength is provided to frame 14 such that walls 24 and 26, at their connections to wheel 16, are rigid and difficult to deflect. Thus, the skater's energy and control during quick and forceful cornering, thrusting, and stopping maneuvers is efficiently and effectively maintained and transferred from the skater's foot to the wheels of skate 10. Minimal energy is lost by any frame flexing due to the stiff frame created by such cross bracing.

Figure 4:
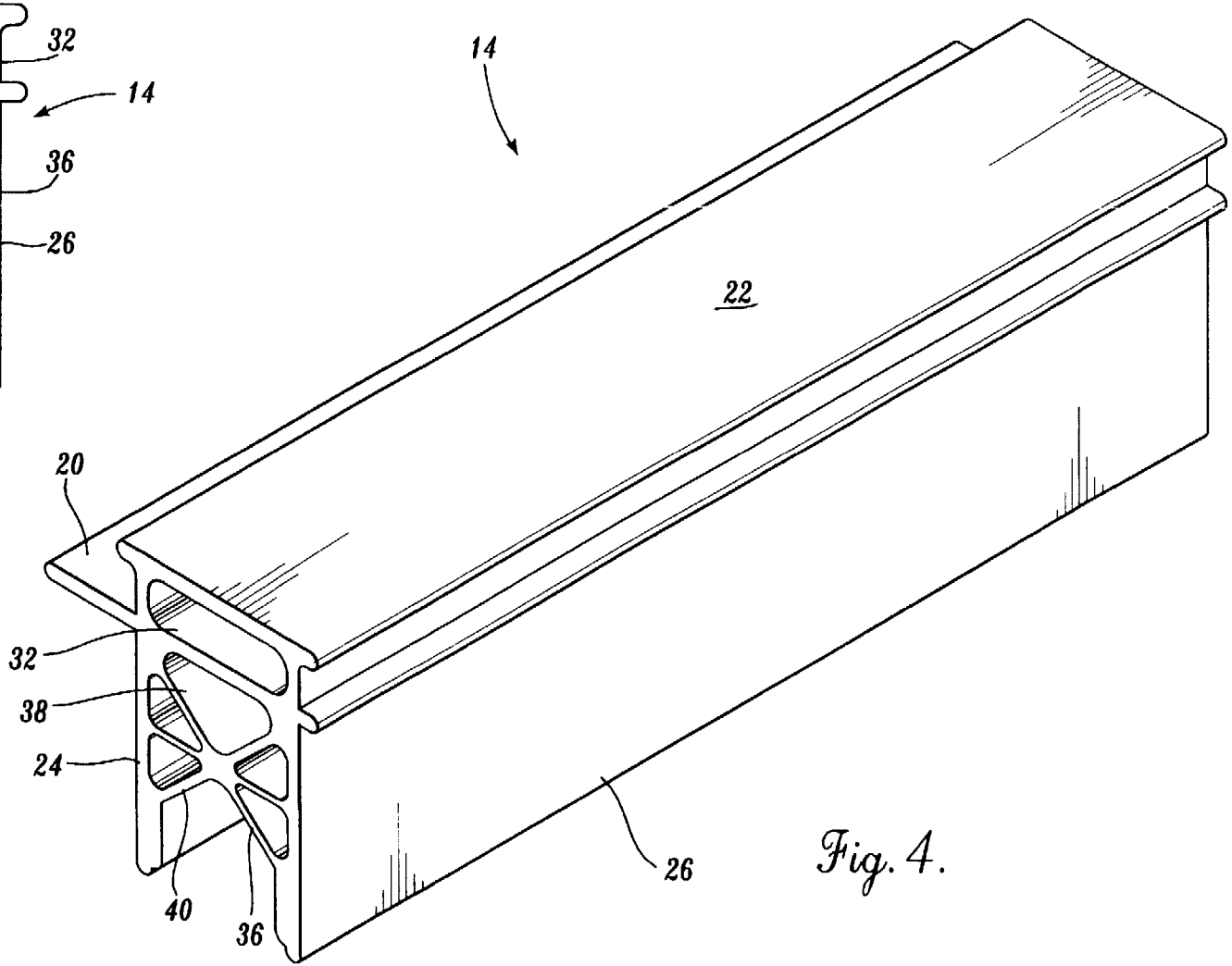
FIG. 4 is an isometric view of the extrusion before being machined.
Figure 3:
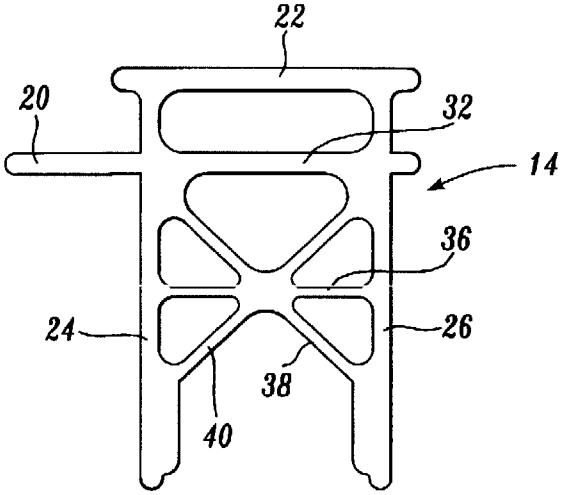
FIG. 3 is a cross-sectional view of an extrusion before machining to construct the frame illustrated in FIGS. 1 and 2.

As illustrated in FIGS. 3 and 4 and as briefly discussed above, the frame is created preferably by extrusion of aluminum. However, pultrusion or extrusion of other materials may also be used to create a frame with cross bracing as described above. Aluminum is extruded through a die and then machined with recesses, wheel wells, and other apertures and curves to create a frame such as that illustrated in FIGS. 1 and 2.

Figure 5:
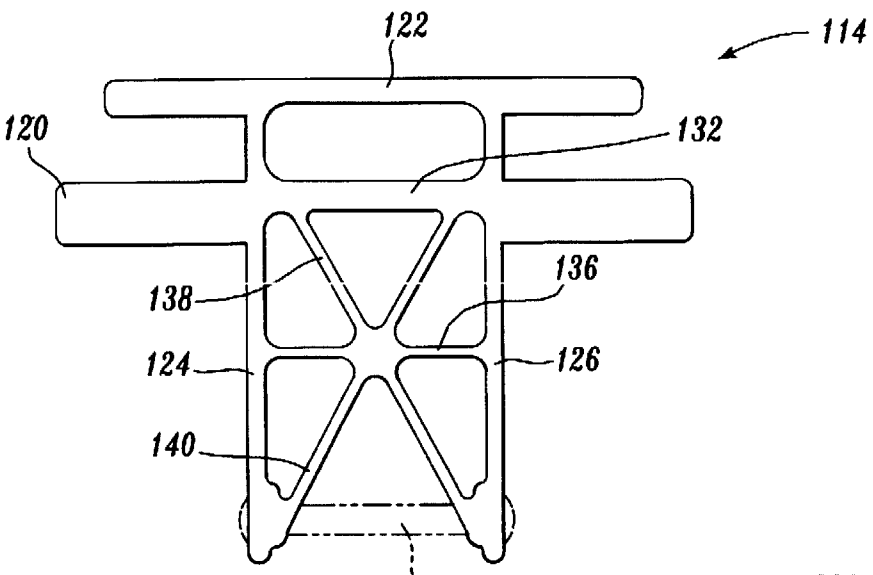
FIG. 5 is an end view of an extrusion for an alternate embodiment of the frame of the present invention including deeper cross braces.

Alternative cross bracing constructions are also encompassed by the present invention. For example, FIG. 5 illustrates an alternate preferred extrusion of a frame 114. The numbering in FIG. 5 corresponds to that of the previous figures except that 100 has been added to each two digit number that generally corresponds to elements of FIGS. 1 through 4. Thus, frame 114 is provided with right and left walls 124 and 126, forward platform 120, and rearward platform 122. A horizontal upper brace 132 is provided as a rearward extension of forward mounting platform 120. In this embodiment, first cross brace 138 extends from right wall 124 by being connected thereto with horizontal upper brace 132. First cross brace 138 extends downwardly much lower than the cross braces illustrated in FIGS. 1 through 4 and described above. First cross brace 138 extends to a lower region of left wall 126 between axle apertures. Likewise, second cross brace 140 extends from horizontal upper brace 132, down to a lower region of right wall 124 to be connected at a position in substantial alignment with axle apertures. Thus, cross braces 138 and 140 provide superior leverage to counteract lateral forces and moments generated by wheels 16. Note that several triangles are created by horizontal midbrace and first and second cross braces 136, 138 and 140. These triangles contribute to the strength of frame 114. Also note that a triangle is effectively created between axle 118 and the lower portions of first and second cross braces 138 and 140. These triangles are created with cross braces that are quite wide in the longitudinal direction and lie within planes parallel to the longitudinal axis of frame 14. These are the most efficient planes to lie within for counteracting lateral the forces involved in skating. Thus, the structural efficiency of frame 114 is extremely high.

Figure 6:
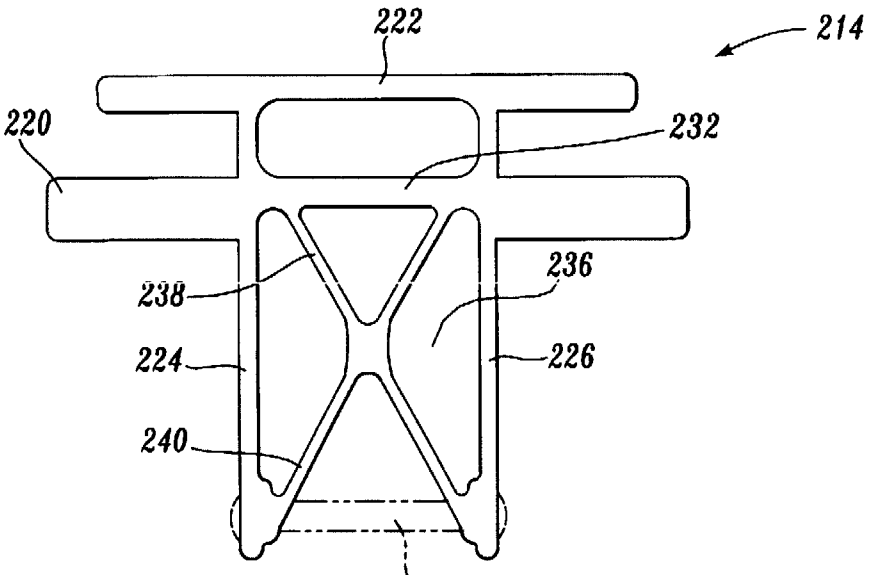
FIG. 6 is an end view of an extrusion of second alternate embodiment of the frame of the present invention without a horizontal midbrace.

FIG. 6 illustrates another alternate embodiment of a frame 214. Frame 214 is very similar to the embodiment illustrated in FIG. 5. Again, like digits are used to number the elements in FIG. 6 except, in this case 200 has been added to each original two digit number to differentiate this embodiment. This embodiment is very similar to FIG. 5 except that horizontal midbrace 136 has been omitted. This would result in a slightly lighter weight skate frame 214. However, triangles are still created with first and second cross braces 238 and 240, intersecting at their midpoints to provide support for one another.

Figure 7:
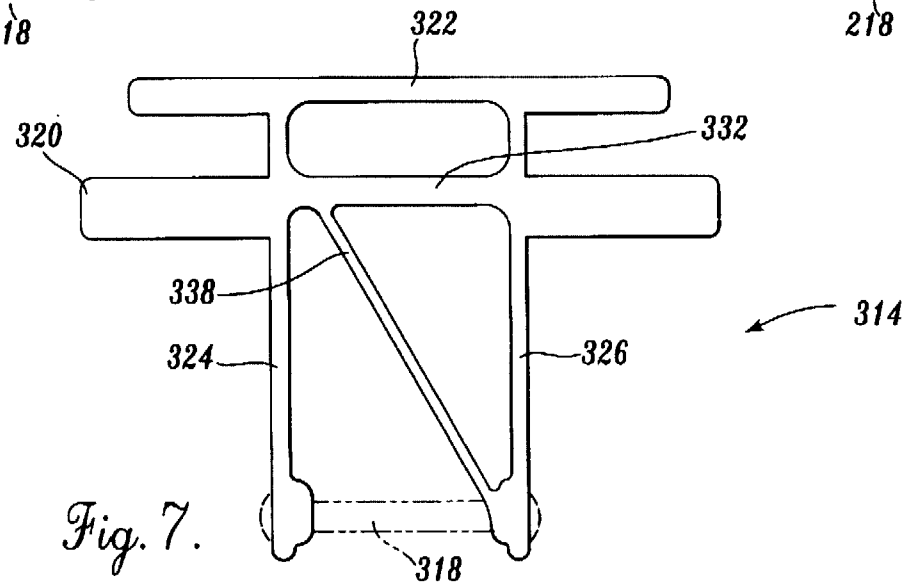
FIG. 7 is an end view of an extrusion for a third alternate embodiment of a frame of the present invention having a single cross brace.

FIG. 7 illustrates a third alternate embodiment with frame 314 (300 being added to each reference number). Frame 314 includes a single cross brace 338 extending from approximately the intersection of horizontal upper brace 332 with right wall 324 down to the lower region of left wall 326 between axle apertures. Strong triangles are also created with this embodiment. One triangle is created between cross brace 338, horizontal upper brace 332, and left wall 326. A second triangle is effectively created between cross brace 338, axle 318, and right wall 324. Thus, while minimal material is ultimately used to provide cross bracing, significant strength is still gained.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. A frame for securing in-line skate wheels to a skate boot, the frame having a longitudinal axis, the frame comprising:

(a) at least one mounting platform adapted for securing the skate boot thereto;

(b) a right wall extending downwardly from said mounting platform and including a lower region having apertures for securing the wheels thereto;

(c) a left wall extending downwardly from said mounting platform and including a lower region having apertures for securing the wheels thereto, the apertures of said walls being substantially aligned; and (d) a first cross brace having a major plane defining a downward facing surface, the downward facing surface extending diagonally down from one of said right wall and said left wall to the other of said right wall and said left wall, said first cross brace also having an upward facing surface, a forward edge, a rearward edge, a lower end attached to one of said walls and an upper end attached to the other of said walls.

2. The frame of claim 1, wherein said first cross brace extends substantially along a plane substantially parallel to the longitudinal axis of the frame.

3. A frame for securing in-line skate wheels to a skate boot, the frame having a longitudinal axis, the frame comprising:

(a) at least one mounting platform adapted for securing the skate boot thereto;

(b) a right wall extending downwardly from said mounting platform and including a lower region having apertures for securing the wheels thereto;

(c) a left wall extending downwardly from said mounting platform and including a lower region having apertures for securing the wheels thereto, the apertures of said walls being substantially aligned; and (d) a first cross brace extending diagonally down from one of said right wall and said left wall to the other of said right wall and said left wall, said first cross brace having an upward facing surface, a downward facing surface, a forward edge, a rearward edge, a lower end attached to one of said walls and an upper end attached to the other of said walls, wherein said first cross brace extends substantially along a plane substantially parallel to the longitudinal axis of the frame, further comprising a second cross brace extending substantially along a plane substantially parallel to the longitudinal axis of the frame and substantially transverse to said first cross brace, said second brace extending from an upper portion of one of said walls to a lower portion of the other of said walls.

4. The frame of claim 3, further comprising a horizontal brace extending between said right wall and said left wall, said horizontal brace being generally parallel to said platform.

5. The frame of claim 2, wherein said lower end of said first cross brace is attached to the lower region of one of said walls.

6. A frame for securing in-line skate wheels to a skate boot, the frame having a longitudinal axis, the frame comprising:

(a) at least one mounting platform adapted for securing the skate boot thereto, (b) a right wall extending downwardly from said mounting platform and including a lower region having apertures for securing the wheels thereto;

(c) a left wall extending downwardly from said mounting platform and including a lower region having apertures for securing the wheels thereto, the apertures of said walls being substantially aligned; and (d) a first cross brace extending diagonally down from one of said right wall and said left wall to the other of said right wall and said left wall, said first cross brace having an upward facing surface, a downward facing surface, a forward edge, a rearward edge, a lower end attached to one of said walls and an upper end attached to the other of said walls, wherein said lower end of said first cross brace is attached to the lower region of one of said walls, further comprising a second cross brace extending substantially along a plane substantially parallel to the longitudinal axis of the frame and substantially transverse to said first cross brace, said second brace extending from an upper portion of one of said walls to a lower portion of the other of said walls.

7. The frame of claim 6, further comprising a horizontal brace extending between said right wall and said left wall, said horizontal brace being generally parallel to said platform.

8. The frame of claim 2, wherein a transverse cross section of said first cross brace, combined with a transverse cross section of one of said right and left walls and a transverse cross section of said platform, substantially forms a triangular shape.

9. The frame of claim 8, wherein said first cross brace is attached to one of said walls between two of the apertures such that said first cross brace is between two wheels when the wheels are secured to the frame.

10. The frame of claim 1, wherein said walls are substantially parallel.

11. The frame of claim 10, wherein said first cross brace extends substantially along a plane substantially parallel to the longitudinal axis of the frame.

12. The frame of claim 11, wherein a transverse cross section of said first cross brace, combined with a transverse cross section of one of said right and left walls, and a transverse cross section of said platform, substantially forms a triangular shape.

13. A frame for securing in-line skate wheels to a skate boot, the frame having a longitudinal axis, the frame comprising:

(a) at least one mounting platform adapted for securing the skate boot thereto;

(b) a right wall extending downwardly from said mounting platform and including a lower region having apertures for securing the wheels thereto;

(c) a left wall extending downwardly from said mounting platform and including a lower region having apertures for securing the wheels thereto, the apertures of said walls being substantially aligned; and (d) a first cross brace disposed between the right and left walls extending diagonally down from said mounting platform to one of said right wall and said left wall, said first cross brace having an upward facing surface, a downward facing surface, a forward edge, a rearward edge, a lower end attached to one of said walls and an upper end attached to said mounting platform.

14. The frame of claim 13, wherein said first cross brace extends substantially along a plane substantially parallel to the longitudinal axis of the frame.

15. The frame of claim 14, wherein said lower end of said first cross brace is attached to the lower region of one of said walls.

16. The frame of claim 15, further comprising a second cross brace extending substantially along a plane substantially parallel to the longitudinal axis of the frame and substantially transverse to said first cross brace, said second brace extending from said mounting platform to a lower portion of one of said walls.

17. The frame of claim 16, further comprising a horizontal brace extending between said right wall and said left wall, said horizontal brace being generally parallel to said platform.

18. The frame of claim 14, wherein a transverse cross section of said first cross brace combined with a transverse cross section of one of said right and left walls and a transverse cross section of said platform substantially forms a triangular shape.

19. The frame of claim 18, further comprising a second cross brace extending substantially along a plane substantially parallel to the longitudinal axis of the frame and substantially transverse to said first cross brace, said second brace extending from said mounting platform to a lower portion of one of said walls.

20. The frame of claim 19, wherein said walls are substantially parallel.

21. A frame for securing in-line skate wheels to a skate boot, the frame having a longitudinal axis, the frame comprising:

(a) at least one mounting platform adapted for securing the skate boot thereto;

(b) a right wall extending downwardly from said mounting platform and including a lower region having apertures for securing the wheels thereto;

(c) a left wall extending downwardly from said mounting platform and including a lower region having apertures for securing the wheels thereto, the apertures of said walls being substantially aligned; and (d) a first cross brace extending diagonally down from said mounting platform to one of said right wall and said left wall, said first cross brace having an upward facing surface, a downward facing surface, a forward edge, a rearward edge, a lower end attached to one of said walls and an upper end attached to said mounting platform, wherein said first cross brace extends substantially along a plane substantially parallel to the longitudinal axis of the frame, wherein said first cross brace is attached to one of said walls between two of the apertures such that said first cross brace is between two wheels when the wheels are secured to the frame.

22. A method of making a skate frame for an in-line skate from a ductile material, the method comprising:

(a) forcing the material through a die having a cross-sectional shape to form two walls, a first platform extending between the two walls, a second platform extending between the two walls below said first platform, and a diagonal cross brace extending from a lower portion of one of the walls to one of the platform and the other of the walls; and (b) machining wheel wells within the cross brace.

* * * * *